United States Patent [19]

Mayhall et al.

[11] 4,283,903

[45] Aug. 18, 1981

[54] PACKAGE WRAPPING MACHINE

[76] Inventors: Riley H. Mayhall, 14130 Columbia Rd., Burtonsville, Md. 20730; Andrew Zudal, 4140 Mt. Olney Ln., Olney, Md. 20832

[21] Appl. No.: 962,610

[22] Filed: Nov. 21, 1978

[51] Int. Cl.[3] ..... B65B 11/04

[52] U.S. Cl. ..... 53/587; 53/211

[58] Field of Search ..... 53/211, 528, 526, 587, 53/588; 100/3, 5, 15

[56] References Cited

U.S. PATENT DOCUMENTS

| | | | |
|---|---|---|---|
| 1,123,606 | 1/1915 | Smith | 53/588 |
| 2,153,483 | 4/1939 | Rose | 53/379 |
| 2,568,260 | 9/1951 | Spagnoli | 53/587 |
| 2,651,900 | 9/1953 | Heilman | 53/588 |
| 2,829,585 | 4/1958 | Varvel | 100/5 |
| 3,262,246 | 7/1966 | Dusen et al. | 53/587 |
| 3,577,702 | 5/1971 | Bescript | 53/587 |
| 3,673,950 | 7/1972 | Koehler | 100/3 |
| 3,994,118 | 11/1976 | Felix | 53/587 |

*Primary Examiner*—John Sipos

*Attorney, Agent, or Firm*—Ronald R. Snider

[57] ABSTRACT

A package wrapping machine which has a frame supporting a power driven rotary horizontal shaft with a turret plate member on the end of the shaft supporting spaced clamp banks, a positioning blade is placed between the said clamp banks for positioning the package components prior to clamping, a stack of package components is clamped between the clamp banks by fluid power cylinders on the turret plate moving one clamp bank toward the other. The end of an elastoplastic wrapping or web extending from a clamp roll on the frame is moved under one clamp bank by insertion of the packages to be wrapped into position. The web is then clamped by the clamp bank to the package components when they are rotated a predetermined number of rotations to effect the wrapping of the package components; a film cut-off means severs the web of wrapping from the wrapped package following the wrapping of the package and a pusher plate between the tine banks is extended by a cylinder to push off the completed package from between the clamp banks and the positioning blade.

14 Claims, 10 Drawing Figures

962610

PACKAGE WRAPPING MACHINE

BACKGROUND OF THE INVENTION

1. Prior Packaging Techniques

This invention is in the field of packaging and is more specifically directed to a new and improved method and apparatus for wrapping a package with plastic film material so as to provide a strong and protective enclosure of the package in an economical manner. The term "package" as used herein is employed in its broadest generic sense and can comprise a plurality of bags, bundles, rolls, cans, or the like which are desired to be associated together in a unitary grouping or a single such bag or similar item about which it is desired to provide a protective wrapping or covering. For example, the finished package provided by the inventive apparatus and method can consist of a plurality of bags such as bags of dog food, potting soil, books, newspapers, underwear or the like. Other examples of items capable of being associated together by the inventive apparatus and method into a unitary package includes tubes, cartons, cans and rolls which are wrapped together by the inventive apparatus and method to provide a unitized package consisting of a desired plurality of the particular items being wrapped.

Recognition of the foregoing problems has resulted in a number of both fully automatic and manual rotational wrapping machines which are used for wrapping items with a thermoset film paper, netting, etc. in a variety of ways. Unfortunately, the known wrapping machines suffer from a lack of versatility in that they are capable of usage for wrapping only products within a relatively narrow range of dimensional configurations. In other words, many of the machines will only wrap a particular type and size of item such as a boxed or pallet mounted item and are incapable of usage for wrapping other items having a different nature, configuration and/or dimensions. Another disadvantage of the prior known wrapping machines resides in the fact that they effect the wrapping operation by rotating the items being wrapped about a vertical axis or push them through a web tunnel which results in poor web tension and a single wrap. One of the problems of many machines arises from the fact that items being wrapped are always maintained in an unchanging fixed vertical orientation; consequently, if the items consist of bags or the like containing powdered or similar materials which tend to settle, the bags will bulge outwardly at their bottom portions so as to result in a non-symmetric finished package which is both aesthetically unattractive and functionally deficient in not being capable of being easily stacked or stored. Another shortcoming of many conventional machines is that they present safety hazards to the operator in that clothing or the like of the operator can be engaged by the moving parts to inflict serious injury or death of the operator.

2. U.S. Application Ser. No. 893,324

In copending U.S. Application Ser. No. 893,324, there is described a plastic film wrapping apparatus having clamping means consisting of two vertically spaced parallel banks of horizontal tines which receive the items to form the package between the two tine banks. The upper tine bank then moves toward the items to be wrapped which are supported on the lower tine bank to clamp and hold the items between the tine banks for rotation about a horizontal axis during the wrapping of the package with wrapping material from a supply roll. The package components are rotated to continuously invert them during the wrapping operation and are not permitted to settle and/or distort the finished package.

The package resultant from the invention of copending U.S. Application Ser. No. 893,324 is that it is aesthetically attractive, permits visual inspection of its contents when desired and is of generally square or rectangular configuration and compacted so as to be easily stacked or stored with similar packages. Moreover, the resultant package provides a substantial energy cost savings over cardboard boxes, bagging, or shrink wrapping. In such manual machines, there is a safety feature which is a pivotally mounted guard shield adjacent the area in which the package components are wrapped; the guard shield has an opening through which the package components are moved for positioning on the lower tine bank. Prior to the commencement of rotation of the package components to begin a wrapping operation, the guard shield swings outwardly to insure that the operator is clear of the machine and cannot possibly be injured by this operation.

In U.S. Application Ser. No. 893,324, there is shown a machine frame supporting a horizontal main drive shaft mounted for rotation about its axis and having a vertical turret plate mounted at one end with a fixedly attached first bank of horizontal clamp and support tines fixedly attached to and extending from the turret plate and a second bank of movable horizontal clamp tines on the turret plates mounted for movement toward or away from the bank of fixedly attached tines on the turret plate. The area between the two tine banks comprises a loading and wrapping station for the package components to be wrapped in that a stack of bags or other package components is positioned on the fixedly attached tines, which are always in a lower position below the movable bank of tines when the turret is stopped at the end of a cycle in a loading position. Clamp cylinder means on the turret are provided with a pressurized work fluid such as compressed air for moving the uppermost movable bank of tine members downwardly to clamp the package components together against the lower bank of tines to hold the package components for subsequent rotation of the turret and the clamped components about the horizontal axis of rotation of the main drive shaft. Such clamping of the end of a web of thermoplastic wrap material extending from a supply roll of such material on the machine frame against the uppermost package component. Consequently, rotation of the package components serves to wrap the web of thermoplastic material about the package components with the number of wraps depending upon the number of rotations of the main drive shaft. Rotation of the turret is stopped automatically after a predetermined number of rotations and a transversely movable carriage, mounted for reciprocation perpendicularly to the axis of rotation of the main drive shaft toward and away from the loading station, is moved forward toward the wrapped package in the station. A hot cutter knife mounted on the carriage consequently engages the taut web of wrapping material extending from the package up to the supply roll to sever the web immediately and a presser plate on the carriage moves against the web end below the hot cutter knife just prior to engagement of the web by the knife and serves to smooth out and press the web end against the underlying thermoplastic wrapping to bond it thereto and provide a finished package; a nonheated web cutter knife can be optionally employed if desired.

The carriage is then moved back from the package and pressure by the tines on the finished package component P is released to permit a pusher plate mounted on the turret adjacent one end of the package to be actuated to discharge the completed package by stripping it outwardly along and from the tines.

The guard shield is then automatically returned to its inner closed position and the apparatus is then ready for a subsequent loading of package components. An air curtain provided by a plurality of air jets in a manifold on the carriage blows the severed end of the web extending from the supply roll upwardly above the loading area in which the next stack of components are to be positioned so that downward movement of the upper tine bank clamps the web end to the stacked package components and subsequent rotation of the package components and tines unreels the web from the roll by wrapping the web about the package components.

In an alternative embodiment shown in U.S. Patent Application Ser. No. 893,324, a fluid power cylinder on the carriage has an elasometric pusher member on its rod which is extended prior to loading to engage the web end for providing a mechanical positioning of the web end above the package components beneath the upper tine banks in addition to the positioning by the air curtain.

SUMMARY OF THE INVENTION

This invention is an improvement of the one disclosed in U.S. Patent Application Ser. No. 893,324 which eliminates many of the expensive and complex parts associated with the carriage and the means for positioning the web under the tines for clamping. The carriage, pusher plate, air curtain and elasometric pusher members are eliminated along with their complex actuator controls and high cost. This invention places the web under the upper clamps or tines by a new and improved method which utilizes the motion of the packages as they enter the wrapping station.

In this invention, the bundle, product or packages to be wrapped are moved into the wrapping station with the leading edge of the bundle engaging the film or web. The leading edge carries the web into the wrapping station and between the bundle/product and the reciprocating tine or clamp. Where the clamp is engaged, the end of the web is held tightly against the bundle/product. A third set of tines or a single blade is fixed on the turret plate between the upper and lower tines or clamps and are used to stop the product or packages when they are inserted into the wrapping station. When the bundle is wrapped, all of the clamps and the positioning blade are wrapped. There is also a dancer-idler roller for moving the web to a run position from the clamp load position which is controlled by an air cylinder and piston rod. The air pressure in said cylinder is controlled in order to provide a cushion support for the dancer-idler roller and to prevent excessive shock or jerking of the web during the wrapping operation. A smooth tack down roller and cutting blade are then moved toward the bundle and stretched web at the end of a wrapping cycle for cutting and tacking the end to the bundled product. Further, by the simple construction and configuration of parts, it is possible to provide for either right or left hand feed of the machine.

A better understanding of the preferred embodiment of the invention will be achieved when the following written description is considered in conjunction with the appended drawings.

OBJECTS AND ADVANTAGES

It is an object of this invention to provide a simplified means for feeding a web of wrapping material to a horizontal bundle wrapping machine.

A further object is to eliminate costly and complex systems used heretofore in attaching the wrapping material to the packages to be wrapped.

A further object is to provide severing of the wrapping material in a manner that allows a cutter blade to approach the wrapped bundle but which does not sever or damage the wrapping on the bundle itself.

A further object is to provide a positive smooth down of the severed wrapping end to the wrapped package, and, when required, a heated tacking roller can be used.

A further object is to provide an increased production rate due to the reduced number of operations, moving parts, complexity of controls, and consumption of pressurized work fluid.

It is a further object to provide for optional right and left hand feed configurations by mere assembly procedures.

The main advantage of this invention is the reduced complexity of the bundle wrapping machine which results in substantial savings in the number of parts required for the machine, and a consequent reduction of energy and maintenance costs which is achieved by reduction of a number of potential parts to fail.

A further advantage is the increased production rate which is achieved through the simplified operation and control. High rates of production are required in modern automatic processing operations.

A further advantage is that the design permits the use of identical parts in right and left handed machines.

Figure 1:
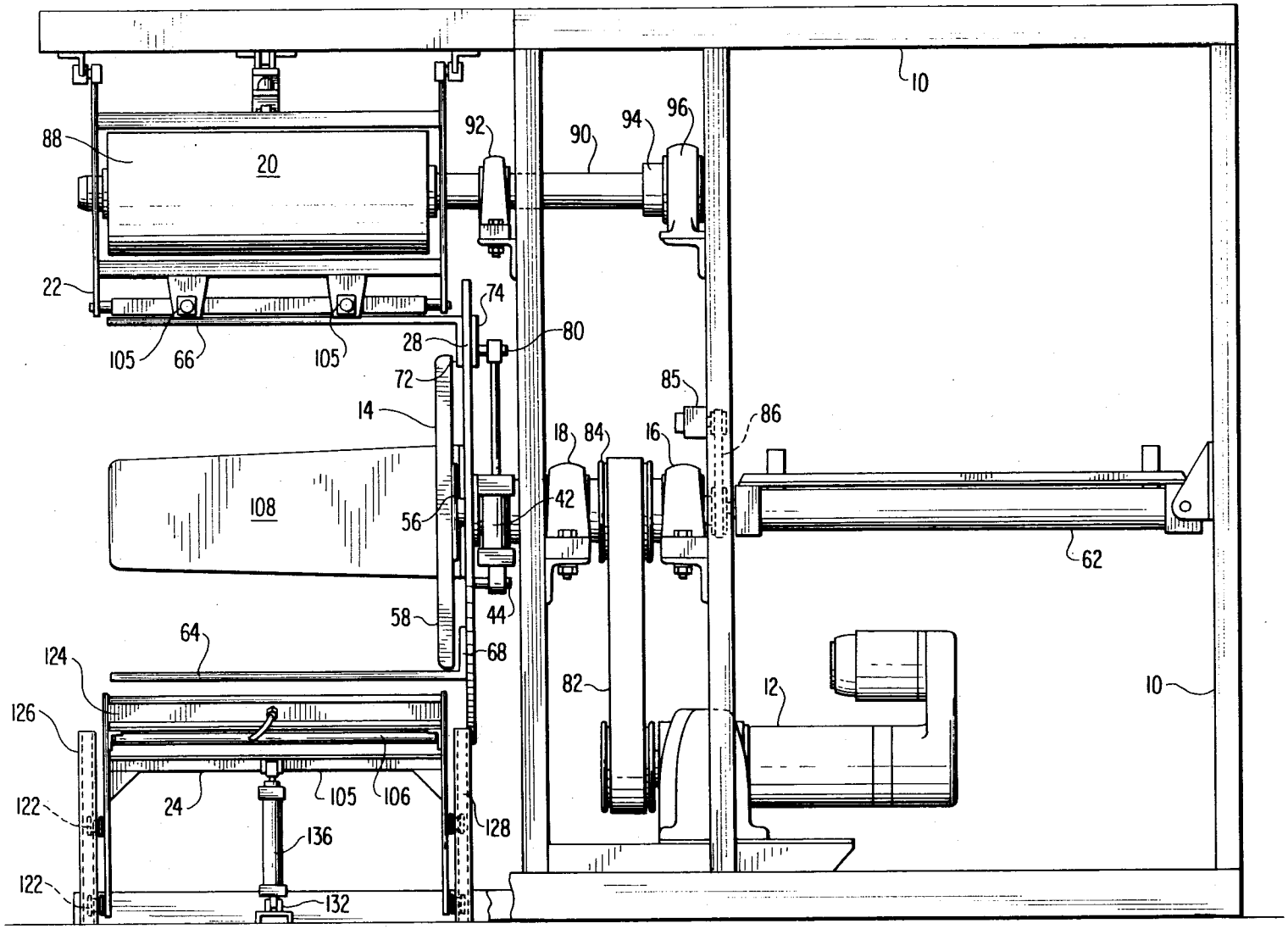
FIG. 1 is a front elevation view of the package wrapping machine.
Figure 2:
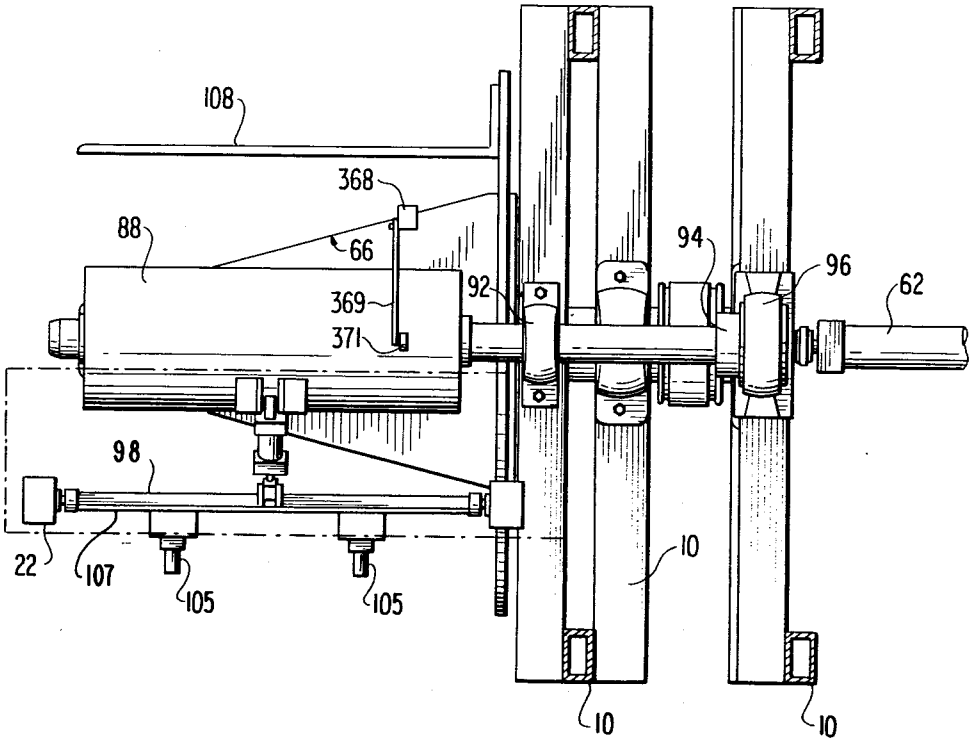
FIG. 2 is a partial top view of the shoving, loading and wrapping station.
Figure 3:
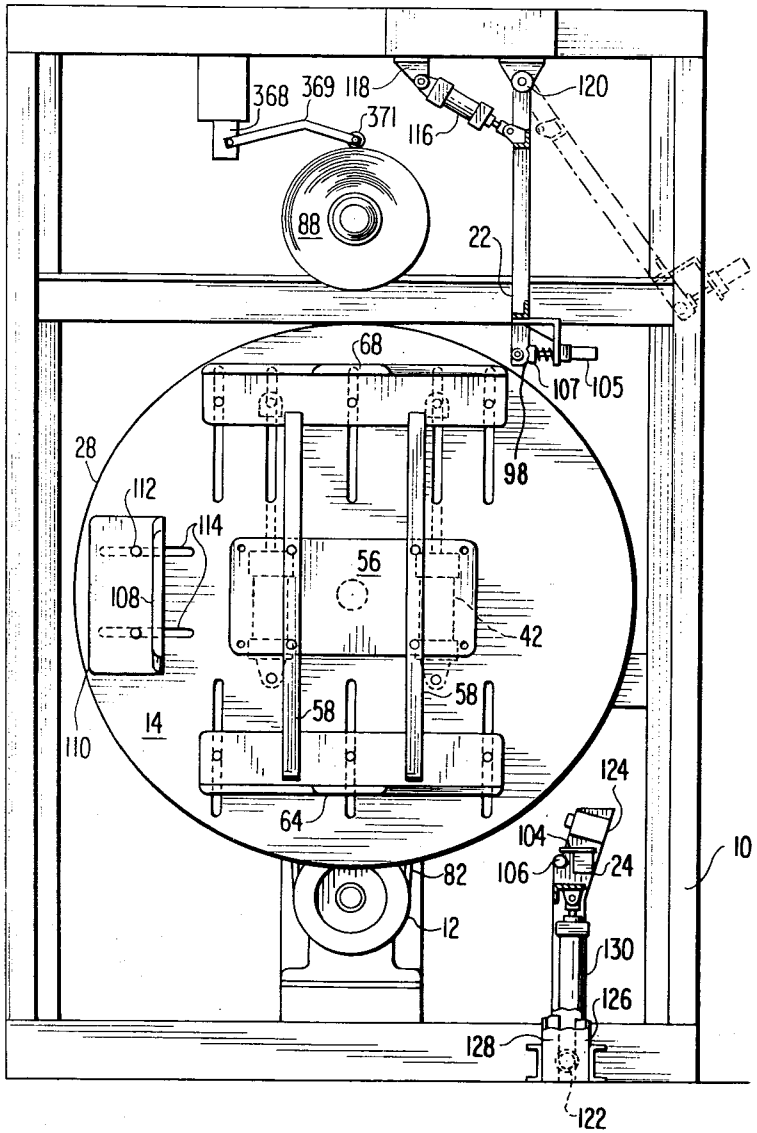
FIG. 3 is a left end view showing the wrapping station and the web positioning apparatus.

Attention is initially invited to FIGS. 1, 2 and 3 which show the frame of the package wrapping machine upon which all other components are mounted. The frame means 10 is constructed of welded steel sections which are of various cross sections. The welded steel sections form an outer frame which may also serve as a convenient location for mounting the enclosure plates for the machine. The various components of the wrapping machine are mounted on the frame such as the drive motor 12 which drives the power driven rotary member about its horizontal axis generally depicted as 14, the rotary member bearings 16 and 18, and the film web and supply means 20. Further, other components such as the dancer-idler 22 and the web cutting means 24 may also be mounted on suitable extensions of the frame which are merely welded in place to support the said components of the machine. The frame, of course, may be of any other suitable design which will securely hold the various operating components in their relative positions according to the specification hereinbelow.

The motor 12 used in this wrapping machine for powering the shaft 26 and the consequent wrapping operations is a three speed device having a first small motor and a second high speed motor with two windings. Through this type of motor control, it is possible to rapidly accelerate and decelerate the rotary member 14 holding the packages to be wrapped.

The main shaft bearings 16 and 18 support the main shaft 26 which is journalled for rotation. A vertically oriented circular plate 28 is mounted on the forward end of the main shaft 26 in abutting relationship with a radial flange 30 (FIG. 4) to which the main turret plate 28 is connected by bolt and nut assemblies 32.

Figure 4:
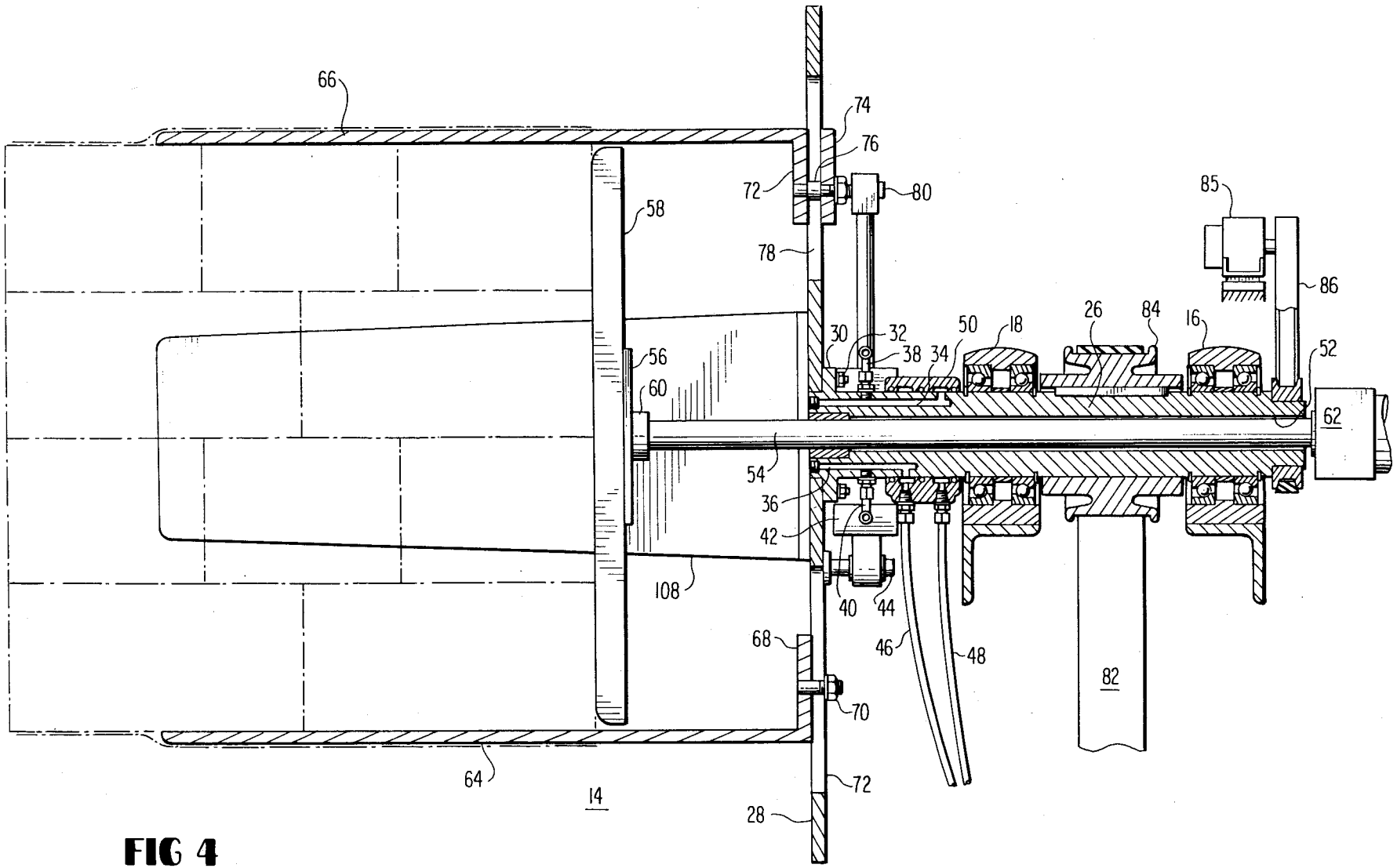
FIG. 4 is a sectional view taken along lines of FIG. 1 showing the mechanism of the rotary member.

The front end portion of the main shaft 26 includes first and second fluid power passageways 34 and 36 with a fluid power hose 38 being in communication with passageway 34 by means of a fitting as shown in FIG. 4 and a similar hose 40 being in communication with the passageway 36 in like manner. Hose members 38 and 40 are each respectively connected to opposite ends of a pair of product clamping fluid power cylinders 42 which have their cylinder portions mounted on pivot members 44 extending from the rear face of turret plate 28. Passageways 34 and 36 also respectively communicate with hose members 46 and 48 by way of a rotary coupling 50 as shown in FIG. 4. The hose members 46 and 48 extend from control valve $V_{-}3$ connected to the output of an air tank or other source of compressed air illustrated in FIG. 9 to permit the supplying of pressurized air to either of hose members 46 and 48 while the other hose member is connected to atmosphere. Consequently, it will be appreciated that air pressure can be applied to either hose member 40 or hose member 38 for effecting simultaneous extension or retraction of the cylinders 42 which operate the package clamping means to be discussed hereinafter. Cylinders 42 are the clamp actuating means and, when extended, such means provide for the maximum spacing position of clamps 64 and 66. It should be understood that, while compressed air is used to operate the air cylinders and the like of the preferred embodiment, any other pressurized power fluid such as hydraulic fluid could be used, if desired.

An axial bore 52 extends the entire length of the main shaft member 26 with a push rod 54 being mounted in the axial bore and having a pusher plate 56 attached to its forward end. A pair of pusher bars 58 is connected to the front face of the pusher plate 56. The end of the push rod 54 is connected to the pusher plate 56 by bearing 60 (FIG. 4) mounted on pusher plate 56, as push-off cylinder 62 mounted on frame 10 is selectively operable for extension and retraction by conventional air pressure supply and control means. It will be seen that extension of pusher cylinder 62 will cause the pusher plate 56 and the attached pusher bars 58 to move to the left position as shown in FIG. 4, and it is this movement which causes the wrapped packages to move off of the clamps.

Additionally, main turret plate 28 also supplies support for the first and second spaced apart clamp members 64 and 66. The upper clamp means 66 is movably mounted, and the lower clamp means 64 is fixed securely to plate 28. The fixed plate 68 is attached to the turret plate 28 by means of a nut and bolt assembly 70. The nut and bolt assembly 70 rides in slots 72 in plate 28 and provide for vertical adjustment of the lower clamp means 64. This adjustment is required when the apparatus is set up for each particular item to be packaged. In normal use, the machine will be set up to handle a particular type of item to be packaged and will not be adjusted on a regular basis to receive different products.

Each of the clamping means 64 and 66 is of a thick triangular shaped piece of structural material with tapered edges. The shape is of an isosceles triangle with the acute angle toward the end away from the plate 28. This can be best seen in FIG. 2 which shows the clamp 66 as viewed from the top.

The ends of the clamps are closer together from the point of attachment to the support plates. This provides for initial contact of the blades and packages at the tips and assists in preventing the packages from slipping out the end of the loading station during rotation.

The upper clamp means 66 is fixed to a pair of clamp support plates 72 and 74 which are respectively positioned on opposite sides of the main turret plate 28. The clamp support plates 72 and 74 are held in their spaced relationship by a spacer means including at least one spacer-idler bearing 76, positioned in a slot 78 formed in turret plate 28. Pivot members 80 are respectively connected to the ends of plates 72 and 74 and to the outer end of the rods of each of the fluid cylinder members 42. Consequently, the simultaneous actuation of the cylinder members 42 effects movement of the upper clamp 66 toward and away from the lower clamp 64 in an obvious manner. The lower clamp 64 is mounted on a support plate 68 which is fixedly connected to the lower portion of the main turret plate 28 as viewed in FIG. 4.

The rotational drive for the main shaft 26 is provided by drive motor 12 which is drivingly connected by a tooth belt drive 82 to a toothed drive cog 84 on said main shaft 26. The motor used for this application is a direct control, three speed gear motor assembly.

An incremental shaft encoder means 85 including digital setting counters is drivingly connected to the main drive shaft 26 and pulley means by a toothed belt 86. An incremental shaft encoder means 85 having a pulley means and digital setting counters is drivingly connected to the main drive shaft 26 by a belt 86. The incremental shaft encoder means 85 is a conventional shaft encoder. The incremental shaft encoder means 85 is a conventional shaft encoder.

A roll of wrap material 88 is supported and affixed to a shaft 90 which is in turn supported by a first bearing 92 and a second bearing 94. The bearing 94 is an integral part of a brake unit 96 of the type manufactured by P. A. Industries, Inc. of 522 Cottage Grove Road, Bloomfield, Connecticut. The bearing 92 and the brake assembly 96 are mounted on suitable extensions of frame 10 which secure the roll within the frame. The brake means 96 applies a predetermined controlled amount of drag to the shaft 90 in order to provide film tension during the wrapping operations. The brake when actuated always applies the resistance to movement of the shaft 90.

A web 100 (FIG. 5) of wrap material is unreeled from the roll 88 for the purpose of being wrapped about a plurality of packaged components which are clamped between clamp members 64, 66.

Figure 5:
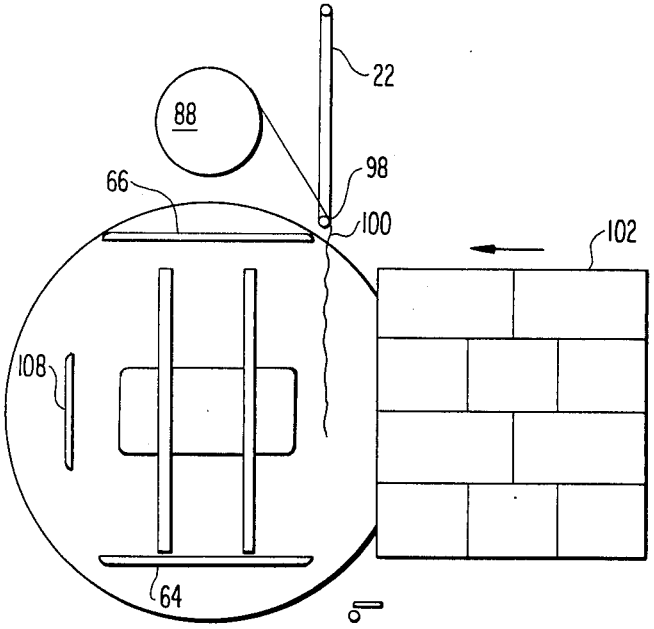
FIG. 5 is a schematic representation showing the left end view with the severed loose end of the package hanging in front of the wrapping station.

As can best be seen in FIG. 3 and schematic diagrams 5, 6, 7 and 8, a dancer-idler 22 is used to position the wrap material 100 in front of the movable upper clamp 66. This is illustrated in FIG. 5. In this condition, the roller 98, as positioned adjacent to the clamp 66, and the web 100 hangs loosely down from the roller 98 in the path of the package components 102 as they are inserted into the wrapping station.

Figure 6:
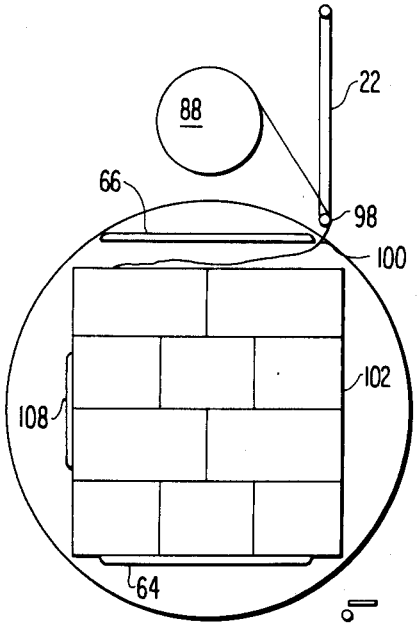
FIG. 6 is a schematic representation of the left end view showing the loose film under the clamps.

FIG. 6 is a similar schematic which shows the package components 102 in place between the clamps with the loose web of material 100 extending between the packages 102 and the upper clamp 66.

Figure 7:
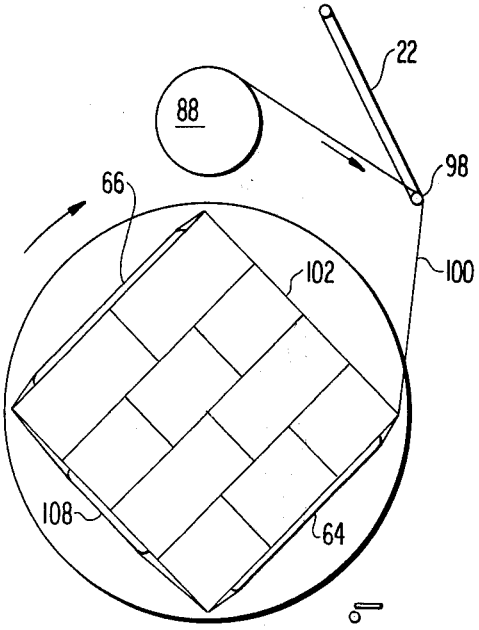
FIG. 7 is a schematic representation of the left end view showing the clamped web during package rotation.

FIG. 7 is a further schematic showing the placement of the dancer-idler 22 and the roller 98 during the wrapping operation. During the wrapping operation, the article clamping means holds the loose end of the web 100 securely in place, and the brake 96 retards the rotation of the roll 88 so as to place tension on the webbing 100 during wrapping. Further, the dancer-idler moves to the right, along with the roller 98 in order to provide clearance away from the spinning package components and clamps.

Figure 8:
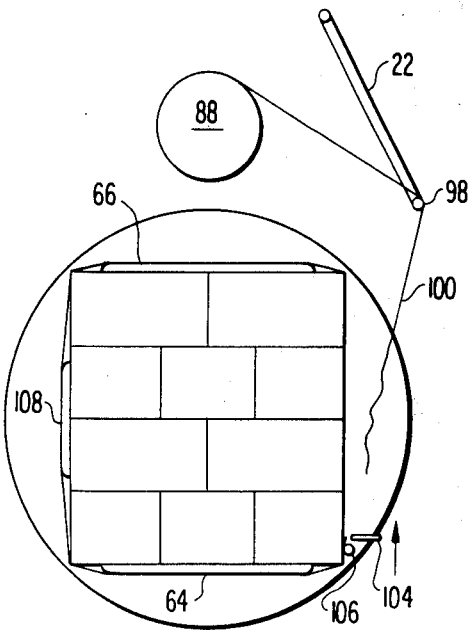
FIG. 8 is a schematic representation of the left end view showing the web as the blade shears the web.

In FIG. 8, there is shown the apparatus as it appears just after to the cutting of the web. In this configuration, the dancer-idler 22 still maintains the roller 98 to the right on a right handed machine and away from the bundle and clamp assembly. This position extends the web away from the bundle at an angle so that the cutting means 104 may engage the wrap 100 without cutting that portion of the wrap 100 which has been wrapped around the clamps 64, 66, the package positioning plate or positioning means 108 and the package components 102. The area between the clamps 64, 66 and the positioning plate 108 defines the loading and wrapping station. The packages 102 are inserted into the wrapping station. As can be seen from FIG. 8, once the web 100 has been severed, there will be a substantial portion of the web remaining loose from the roller 98. It is this portion of the web which serves as the loose portion which will be carried into the wrapping station at the initiation of the next wrapping cycle wherein the package components are inserted into the wrapping station. Also shown in FIG. 8 is the roller means 106 which moves on the same carriage mechanism as the blade 104. The carriage and the blade 104 constitute the film cut-off means for severing the web or film. The roller 106 engages the wrapped bundle and presses the loose portion or the severed portion of the web against the bundle in order to assure the adherence of the loose portion to the bundle. Roller 106 may be heated to provide improved sealing. The web 100 may be of the type known as a self-adhering plastic film. The dancer-idler combination 22 may also include a clamping bar 107, shown in FIGS. 2 and 3, which is moved against the roller 98 during certain portions of the operating cycle. The clamp bar 107 is engaged with the roller 98 at a time just before the cutting of the web as depicted in FIG. 8 and remains engaged until the web 100 is clamped against the packages 102 in the next wrap cycle. Clamp bar 107 is actuated by an air cylinder 105. As the web is severed, in FIG. 8, the loose portion of the web material will hang down from roller 98. While the clamp bar 107 is still in engagement, the wrapped packages are ejected from the loading station. The dancer-idler 22 then moves back to its first position as shown in FIG. 5 with the clamp 107 still holding the roller 98 and the web 100. The clamp bar 107 is also maintained in its clamping position until the packages are inserted into the wrapping station as shown in FIG. 6. The clamp is then disengaged to allow wrapping of the material about the clamps and packages as depicted in FIG. 7.

In FIGS. 2 and 3, there is shown a package positioning means or third isosceles-shaped elongated blade 108 located at the backside of the loading station, or to the left side of a right handed machine of the main turret plate 28 as viewed in FIG. 3. The positioning means 108 is mounted on a flat plate 110 which is secured to the turret plate 28 by means of bolts 112. The bolts 112 secure the package positioning blade 108 in a plurality of positions dependent upon the nature of the articles to be wrapped by the machine. Slots 114 are in the turret plate 28 to permit this adjustment.

A plurality of pusher bars 58 are mounted on pusher plate 56. The pusher bars 58 are sized in accordance with the load and clamp means configuration, and, as can best be seen in FIG. 3, they ride essentially along the surface of the lower clamp means 64. The point of contact between the pushers 58 and 64 constitutes a bearing surface for this push-off movement. The pushers 58 are made of a bearing-like material, and therefore provide a low friction type of contact with the plate 64. The pusher bars extend only to a point below the location of the upper clamp plate 66 when it has clamped the article to be wrapped in place. By this construction, the placement of the pusher bars 58 proximate to the lower clamp means 64 prevents rotation of the pusher bars and pusher plates 56 relative to the lower clamp 64 and the main turret plate 28. The package ejecting means is comprised of the push-off cylinder 62 in combination with the pusher bars 58.

The dancer-idler mechanism 22 has a first position which positions the web material adjacent to the upper clamps 66, as seen in FIG. 5, and a second position which locates the feed position of the web of material well away from the packages to be wrapped, as seen in FIG. 7. The dancer-idler 22 is the means for positioning a first loose portion of the film in front of the packages as they are inserted. The dancer-idler is controlled by a power cylinder 116, shown in FIGS. 2 and 3, which is fixed to the frame 10 at a point 118. The power cylinder 116 is the means for moving the means for positioning 22 and is compressed fluid operated by the work fluid supply system which controls the various functions of the machine during operation. The pressure in the power cylinder is adjusted so that it remains relatively low, when the dancer-idler is in either its first or second positions. This low pressure in the power cylinder 116 provides a cushioning effect for the dancer-idler 22, which is pivoted about point 120. By this approach, the power cylinder serves the dual functions of positioning of the dancer-idler and of providing the resilient cushion which may be required to prevent snapping or breaking of the web during portions of the operating cycle.

The cutter bar and roller assembly 24, best shown in FIGS. 1 and 3, constitutes a film cut-off means 104 and a means for applying pressure to the loose portion next to the package such as roller 106. The blade 104 and the roller 106 are spring-slider mounted on a common carriage which moves up and down vertically. The carriage 105 is carried by a set of wheels 122 and tracks 126 and 128. The wheels 126 carry the carriage 105, the roller 106 and cutter 104 upward and into contact with the web. An air cylinder actuating means 130 is connected to the carriage 105 at one end and to the frame 10 at point 132. The air cylinder 130 is the means for moving the blade 104 toward the web. Point 130 may comprise a bolt or any suitable attachment means.

There may also be mounted on the carriage a vacuum holding or suction means 124 which engages the web 100 immediately prior to the cutting operation by the cutting blade 104. This vacuum suction will hold the web firmly as the cutter blade presses the material. The vacuum holder can then be released to allow the web to assume its relaxed position prior to initiating the next cycle of the machine.

Figure 9:
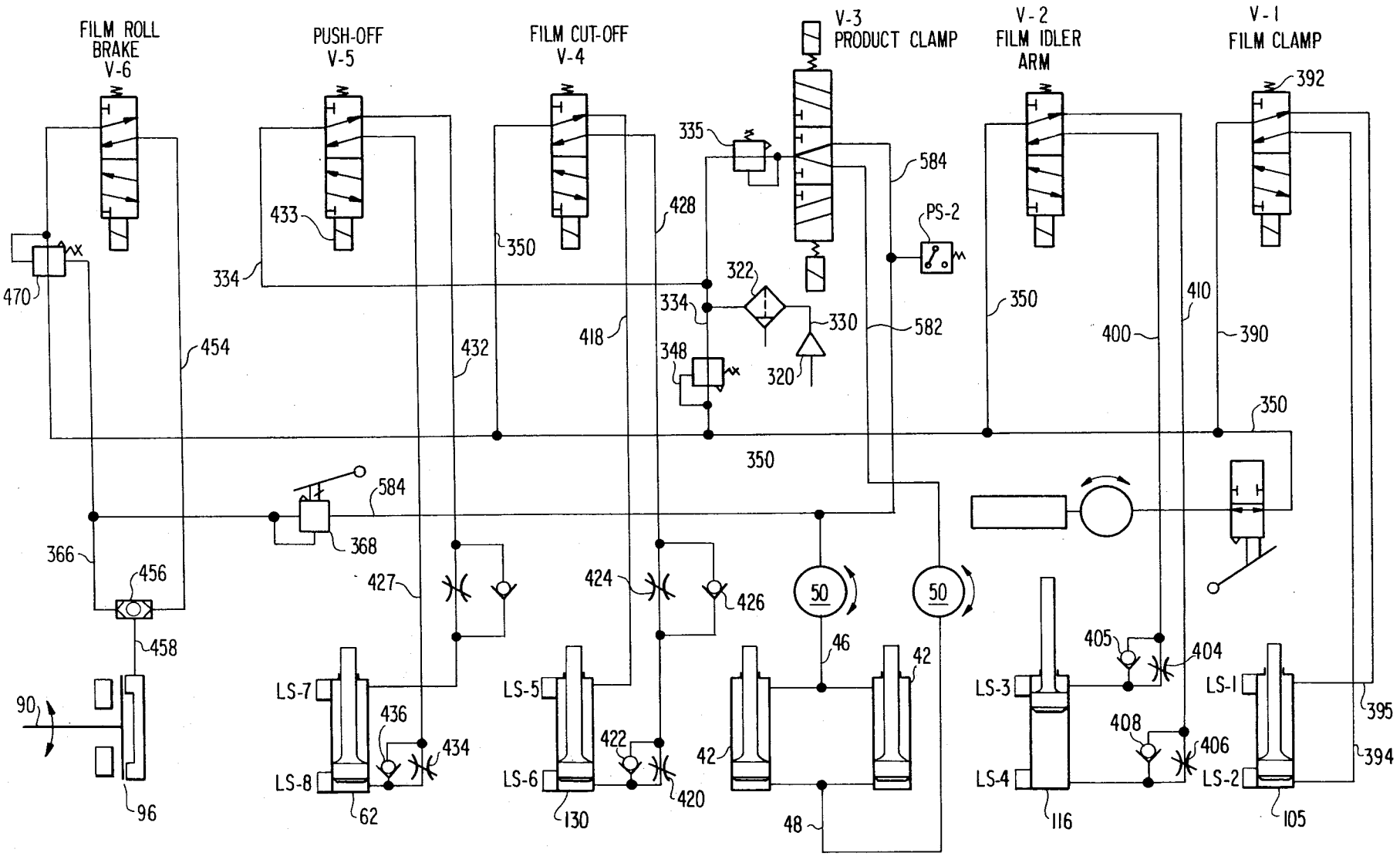
FIG. 9 is a schematic diagram of an electropneumatic control that can be used for sequential control.

FIG. 9 illustrates the electro-pneumatic control and power system for controlling the various pneumatic cylinders. The control may be of other known types. Specifically, a source of compressed work fluid 320 at between 90 and 160 pounds per square inch supplies work fluid to a filter 322 which filters the work fluid then flowing through a line 330 to a distribution line 334 which is connected to a plurality of controlled valve members to be discussed.

The distribution line 334 to a pressure regulator 335 which is in turn connected to a product clamp valve V3 to which the hose members 582 and 584 are connected. The opposite ends of the hose member 582 and 584 are connected to the rotary coupling 50 to provide communication with the hoses 46 and 48 which are connected to the product clamping cylinders 42. Fluid through hose 46 contracts the cylinders 42 while fluid in hose 48 extends the cylinders to an unclamping position in which the upper clamp member 66 is in the position at the greatest possible distance from the lower clamp for permitting the loading of the packages 102 on the lower clamp. A pressure sensitive switch PS2 is connected to hose 584 and has contacts close when pressure in the hose equals or exceeds a desired value necessary for clamping and safely holding packages 108 during a wrapping operation. The hose 584 extends from the product clamp valve V3 to the rotary coupling 50 to provide communication with the hose 48 which is connected to the rod end of cylinder 42 so that the supply of compressed fluid through hose 584 effects a clamping of the package components supported on the lower clamp 64. It should be observed that a pressure sensitive switch PS2 is connected to the hose 584 for ensuring that adequate clamping pressure is always present in the hose. PS2 prevents operation of the machine by precluding operation of a cycle initiating relay R5 (FIG. 10) in the event of the pressure in hose 584 falling below the predetermined number of pounds per square inch required for maintaining adequate clamping force on the packages 102.

The high pressure line 334 is connected to a pressure regulator 348. The pressure regulator 348 reduces the pressure to a predetermined pressure. Connected to the low pressure line 350 are the film clamp valve V1, the film idler arm or dancer-idler valve V2, the film cut-off valve V4, and film roll brake V6.

The high pressure line 334, in addition to feeding the pressure reducing valve 348 also feeds high pressure directly to the push-off valve V5.

The brake valve V6 is a single output line 454 which is connected to a shuttle valve 456. The shuttle valve has an output line 458 which feeds the pneumatic pressure to the brake mechanism 96 which in turn controls the braking force applied to the film roll shaft 90. The high pressure is required at the portion of the cycle wherein the film roll must be brought to rest rapidly as the main shaft 26 is brought to rest. Without the additional braking applied by the high pressure supplied by lines 454 and 458 under control of brake valve V6, there would be a tendency for the film roll to overrun its stopped position. The film roll may move at a speed of approximately 1,000 rpm, and may weigh in excess of 60 pounds, and, for this reason, the high pressure brake is essential.

Also applied to the shuttle valve 456 is a second source of air from line 584 which is the line which feeds the product clamp cylinders 42. When the product clamp is engaged, line 584 is under regulated high pressure. A pressure control regulator 368 is connected to line 584 to provide a lower controlled pressure to the brake 90 during the time that the film clamp is actuated and during the time that the brake valve V6 is off.

This control regulator 368 is operated by an arm 369 and a roller 371 which rides on the film roll 88. The pressure control regulator 368 is therefore regulated as a function of the diameter of the roll. This adjusts the pressure and drop tension to compensate for the change in momentum of the roll as the web is consumed during operation.

When the film roll brake valve V6 is turned on, high pressure feeds down line 454 and the shuttle valve 456 permits the high pressure to flow to brake 96 by way of line 458 and cuts off the flow of air to line 366 and the pressure reducing valve 368.

Also connected to line 366 is a pressure differential regulator 470. Differential regulator 470 also adjusts the high pressure from line 350 to compensate for changes in the momentum of the roll 88 as web 100 is consumed. When the roll diameter decreases, the brake pressure must be reduced in order to prevent snapping of the web.

In operation, the brake provides for high pressure braking which stops the roll, and for low pressure braking which maintains tension on the web during wrapping operations.

The film clamp solenoid control valve V1 is connected by a conduit 390 to the distribution conduit 350 and the valve is normally maintained in the closed position illustrated in FIG. 9 by a positioning spring 392. Conduits 394 and 395 extend from valve V1 and are connected to the air clamp cylinders 105. Actuation of the solenoid film clamp valve V2 positions the valve to provide pressurized air to conduit 394 to cause the air clamp cylinders to be extended to effect a clamping of the web 100.

The push-off solenoid control valve V5 receives air from the conduit 334 at supply pressure and when positioned by solenoid 433 directs the pressurized air to a conduit 427 having a manually adjustable flow control valve 434 and a parallel bypass check valve 436 with the end of the conduit being connected to the extend inlet port of the cylinder 62 of FIG. 1. Similarly, the rod end of the cylinder 62 is connected to conduit 432 for the return stroke.

The push-off solenoid control valve V7 includes a spring 433 normally maintaining the valve in the position illustrated in FIG. 9 in which the push-off plate is retracted since cylinder 102 is retracted.

The film cut-off valve V4 is connected to the low pressure line 350 and has two outputs 418 and 428. A check valve 422 and a control valve 420, as well as check valve 426 and control valve 424 are used to control the flow of low pressure air to the cutter control piston assembly 130. This cutter control assembly is the actuating means 130 which actuates the cutter blade 104 and the roller 122 as described above.

The dancer-idler or film idler arm control valve V2 has an input line 350 and output lines 400, 410. Check valves 405 and 408 are provided along with flow control valves 406 and 404 for controlling the flow of the fluid to the dancer-idler actuating cylinder 116.

Figure 10:
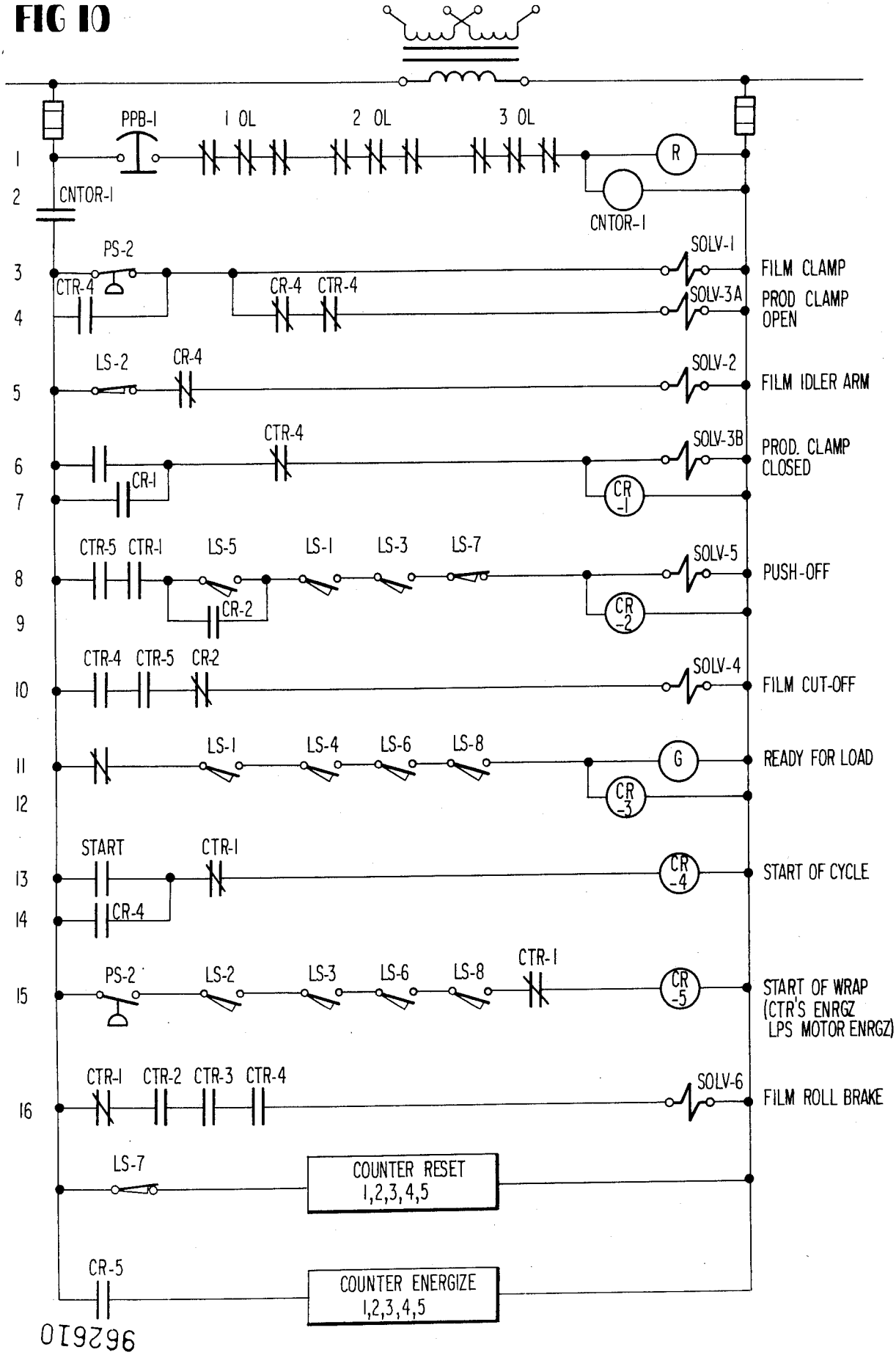
FIG. 10 is a diagram of the electrical control of the machine.

In FIG. 10, there is shown the ladder diagram which is used for control of the wrapping machine described herein. Before discussing in detail the latter diagram, it should be noted that this machine can utilize a central control unit similar to the type known as a Line-O-Logis Controller manufactured by Automatic Timing and Controls Company of King of Prussia, Pennsylvania. The specific model utilized in this device is known as the LDC-40. In this type of controller, there are numerous counters and controls, all of which respond to an encoder which measures the position of a basic machine rotating element. In this particular machine, encoder 85 is connected by means of toothed belt 86 to measure the position of the shaft 26 during wrapping operations. Various counters count the pulses from encoder 85, and when certain predetermined counts are reached, certain machine functions are initiated or terminated.

Now, with specific reference to FIG. 10, it should be first noted that the symbol CTR refers to a digital counter. There are five counters used in this embodiment of the invention. The first counter CTR-1 responds to encoder 85 and counts the revolutions of the shaft 26. This is the main counter for predetermining the end of a wrapping operation. Counter 2 counts a preset number of pulses from encoder 85 for controlling the medium speed motor. Counter 3 counts a slightly greater number of pulses from encoder 85 than counter 2 and is used to energize the high speed motor and to de-energize the medium speed motor which is energized in response to counter 2. Counter 4 counts pulses from encoder 85 and is used to de-energize the large motor. Counter 5 is associated with the film roll brake and detects a predetermined number of revolutions of the shaft 90. Counter 5 is used to detect a break or pull out of the web. Referring now specifically to FIG. 10, in line 1, there is shown as element PPB-1, the power-on control for all controls. PPB-1 is the main power switch for the machine. In series with contactor PPB-1 are a number of motor overload relays generally depicted as 1-OL, 2-OL and 3-OL. These overload sensors will open the circuit and prevent energy from reaching the coil of contactor 1 and will stop all operations if motors are overloaded.

At line 2, CNTOR-1 (contactor) applies power to the main machine control ladder.

In line 3, there is shown pressure switch PS-2, which senses the product clamp pressure and which is closed when there is no pressure at the product clamp cylinders 42. When switch PS-2 is closed, the solenoid valve V-1 is energized and the film clamp will be applied. At line 4, connected in series with PS-2 is CTR-4 (counter 4) which will also energize the film clamp solenoid valve when the high speed motor shuts down. Again, on line 4, there is shown a control contact CR-4, and another contact of CTR-4 which are used to control the product clamp open solenoid valve.

In line 5, there is shown limit switch LS-2 which is also shown on the film clamp actuator 105 in FIG. 9. LS-2 detects the film clamp open position. CR-4 of line 5 is controlled by the coil CR-4 which is directly connected to the start contact at line 13 of FIG. 10. Thus, LS-2 and CR-4 combine to control solenoid valve SOLV-2 of the film idler arm valve V2, which is depicted in FIG. 9.

At line 6 of FIG. 10, there is first shown a start contact which, when closed, energizes a product clamp solenoid. Associated with this start switch are control relay 1 with its control coil CR-1 and contacts CR-1. The CR-1 arrangement is merely a latch arrangement which permits starting of the wrapping cycle by a momentary closing of the start contact.

In line 8, there are shown the various conditions necessary for actuation of the push-off by way of valve V5. The first condition is that CTR-5 (counter 5) must indicate that there has been film applied to the wrapping. Second, counter 1 (CTR-1) must indicate that the wrapping cycle is complete. Next, limit switch LS-5 must indicate that the film cut-off has been actuated and then LS-1 must indicate that the film clamp has been closed. LS-3 must indicate that the film idler arm is in its extended position away from the wrapping, and, finally, LS-7 is shown in its closed position and will only open when the push-off arm has extended. When the push-off arm is actuated, LS-5 will also begin to retract, and across LS-5 is placed a relay contact CR-2 which is controlled by the CR-2 coil. This produces a latching arrangement and allows retraction of the film cut-off during push-off. When the push-off rod 54 is extended, LS-7 will open, and the power to solenoid 5 will be cut-off.

In line 10, there is shown the control for the film cut-off. The film cut-off is responsive to counter 4, counter 5 and control relay 2. Control relay 2 is the relay which is controlled by the push-off. When control relay coil CR-2 (line 9) is not energized, CR-2 of line 10 will be closed. By this technique, energization of the film cut-off cylinder 130 is prevented during push-off operations.

In line 11, there is shown the conditions required for loading. Shown first is CR-4 which is normally closed but which will open when the coil CR-4 (line 13) is energized. Thus, the ready-for-loading green light will immediately go out upon energization of the start of cycle contact at line 13. Also, in line 11 for the ready-to-load condition, are limit switch LS-1 associated with the film clamp, limit switch LS-4 connected to the film idler arm, limit switch LS-6 connected to the film cut-off and limit switch LS-8 connected to the film push-off. In essence, each of these limit switches senses the correct position of each machine element. At line 12, there is shown the coil for control relay 3.

At line 13, there is shown the start of cycle contact which may be push-button or contacts on in-feed means-closed momentarily. A coil CR-4 and contacts CR-4 are used to latch the start cycle. Also shown here are contacts of counter 1, and these contacts remain closed until counter 1 is energized and completes its count.

Line 15 shows the conditions necessary for the initiation of the wrapping operation. These conditions are that the pressure switch PS-2 indicate that there is pressure in the product clamps, that the film clamps be open (LS-2), that the film idler arm be away from the wrapping area (LS-3), that the film cut-off be retracted (LS-6), that the push-off be retracted (LS-8), and that the counter 1 has not counted out. When these conditions exist, the coil of control relay 5 will be energized and power will be applied to the motors and that all CTR's are actuated.

Line 16 shows the film roll brake control, which is applied to solenoid valve 6. In essence, it requires that the three motor counters (CTR-2, -3 and -4) have completed their cycles, in order that the film roll brake be applied for a predetermined length of time.

In line 17, there is shown the counter reset which is responsive to limit switch LS-7 of the push-off rod cylinder.

In line 18, there is shown the counter energization. To energize the counters, the coil control relay 5 must be turned on, and this is accomplished at the beginning of the wrapping cycle in accordance with line 15.

From the above description, it can be seen that this invention provides a completely automatic film wrapping technique of a simplified form which may be used to wrap products in plastic films or other materials which may be of the self-adhesive type.

We claim:

1. A stretch film package wrapping machine for wrapping package components in a plurality of self-adhering film layers comprising in combination:

a. A frame means;

b. A power driven rotary turret plate mounted on said frame means for rotation about a horizontal axis;

c. A loading and wrapping station including cantilevered article clamping means mounted on said turret plate for clamping and holding components during wrapping, wherein said clamping means includes first fixed and second movable clamp members having horizontal axes and clamp actuating means for effecting controlled relative movement of said clamp members toward each other to clamp package components positioned between said clamp members and for moving said clamp members to a position of maximum spacing to permit the insertion of said package components;

d. A control means for actuating said clamping means, rotating said turret plate more than one revolution to thereby wrap said package components, and for controlling all other required machine functions;

e. A means controlled by said control means for positioning a first loose portion of said web of stretch film at a first position in close proximity to said movable clamp member and in the path of said package components to be wrapped when inserted into the wrapping station between said clamp means, whereby said package components carry said loose portion of said film under said movable clamp member during insertion so that upon movement of said movable clamp member, said film is clamped between said movable member and the package components;

f. A means for moving said means for positioning a loose portion of said web after said clamping means is actuated to a second position which is away from said clamping means a sufficient distance that will permit said rotary member to rotate without hitting said means for positioning of said web during the wrapping of said packages and which provides separation of the last layer of said wrapped film from the wrapped package for severing of said web on completion of the wrapping operation;

g. A stretch film web feeding, tensioning and supply means mounted on said frame means for providing a web of film extending to said clamping means and package components held by said clamping means so that a plurality of rotations of said turret plate and said clamping means about said horizontal axis effects the wrapping of said clamping means and said package components;

h. A film cut-off means for severing the web of stretch film from the multi-layer wrapped package following the wrapping of the package and said clamp means; and i. A package ejecting means for ejecting said multi-layer wrapped package from said clamping means at the completion of a cycle of operation.

2. The apparatus of claim 16 further including a package positioning means mounted between said first fixed and second movable clamp members on said turret plate, for positioning the package components to be wrapped prior to wrapping in said wrapping station wherein said positioning means is wrapped by said multi-layer stretch film.

3. The package wrapping machine of claim 1 wherein said film cut-off means for severing the web includes an elongated heated blade movably mounted below said wrapping station and means for moving said blade toward said web after said rotary member has stopped rotating and while said means for positioning said web is in said second position, whereby said web is severed and a first severed portion of the web remains attached to the package and a second severed part hangs from said means for positioning said web.

4. The package wrapping machine of claim 1 further including a web supply which has a control actuated brake means for deceleration and stopping of the rotatably mounted web supply roll on completion of a predetermined amount of the rotational winding of said stretch film.

5. The package wrapping machine of claim 1 further including a web supply which has a low hysteresis brake means for maintaining a predetermined, controlled drag on said roll only when said clamps are closed, wherein said web is maintained in a predetermined, controlled tension during the wrapping of said packages and desired tension characteristics are maintained regardless of changes in said roll diameter.

6. The package wrapping machine of claim 2 wherein said film cut-off means for severing the web includes an elongated, heated blade and means for moving said blade toward said web after said rotary member has stopped rotating and while said means for positioning said web is in said second position, whereby said web is severed and web clamp means mounted on said means for positioning said web and for holding such web during severing of said web and during movement of said packages as they enter said wrapping station.

7. The apparatus of claim 3 further including web closure means for positioning said web during severing and applying pressure to said loose severed portion of said web whereby said loose portion is brought into contact with the web previously wrapped on said package to assure the bonding of the loose portion of the web to the wrapped package.

8. The apparatus of claim 7 wherein said web closure means is a heated roller which tacks and seals said web.

9. The apparatus of claim 1 wherein said means for positioning a loose end is positioned immediately in front of said movable clamping means and above the path of said packages as they are inserted into said wrapping machine.

10. The apparatus of claim 1 further comprising a package positioning means mounted on said power driven rotary turret for positioning said packages when they are inserted into said wrapping station, wherein said package positioning means is wrapped by said multi-layer stretch film.

11. The apparatus of claim 9 wherein said package positioning means comprises a fixed positioning blade mounted opposite the loading entrance of said loading station.

12. The apparatus of claim 1 wherein said means for positioning said web comprises a control means actuated movable horizontal dancer-idler and control means actuated clamp means positioned adjacent to said roller for clamping said web against the horizontal dancer-idler guide roller when packages are inserted into said loading station and when said film cut-off means severs said web.

13. The package wrapping machine of claim 1 wherein said frame and functioning parts are constructed so that the machine may be assembled for either right or left hand feed to the wrapping station with identical parts and the same number of parts.

14. The package wrapping machine of claim 1 wherein said cantilevered article clamping means are closer together at the ends than at the point of attachment to the turret plate, whereby said packages are first engaged by the clamp tips during clamping.

* * * * *